US011143136B1

(12) United States Patent
Turner, Jr.

(10) Patent No.: US 11,143,136 B1
(45) Date of Patent: Oct. 12, 2021

(54) POWER SYSTEM WITH INTERNAL COMBUSTION ENGINE

(71) Applicant: NEXT GENERATION ENGINES LLC, Bonita Springs, FL (US)

(72) Inventor: Alfred A. Turner, Jr., Bonita Springs, FL (US)

(73) Assignee: NEW GENERATION ENGINES LLC

( * ) Notice: Subject to any disclaimer, the term of this patent is extended or adjusted under 35 U.S.C. 154(b) by 0 days.

(21) Appl. No.: 17/374,735

(22) Filed: Jul. 13, 2021

(51) Int. Cl.

| | |
|---|---|
| ***F02D 41/38*** | (2006.01) |
| ***F01L 7/00*** | (2006.01) |
| ***F02B 75/02*** | (2006.01) |
| ***F02M 25/03*** | (2006.01) |
| ***F02D 21/02*** | (2006.01) |
| ***F02M 25/10*** | (2006.01) |

(52) U.S. Cl.
CPC ..... *F02D 41/38* (2013.01); *F01L 7/00* (2013.01); *F02B 75/02* (2013.01); *F02D 21/02* (2013.01); *F02M 25/03* (2013.01); *F02M 25/10* (2013.01); *F02B 2075/025* (2013.01); *F02D 2041/389* (2013.01)

(58) Field of Classification Search
CPC .... F02D 41/38; F02D 21/02; F02D 2041/389; F02M 25/03; F02M 25/10; F01L 17/00; F02B 75/02; F02B 2075/025
USPC ..... 123/25 A, 25 C, 536, 585, 299, 300, 431
See application file for complete search history.

(56) References Cited

U.S. PATENT DOCUMENTS

| | | | | |
|---|---|---|---|---|
| 3,696,795 A * | 10/1972 | Smith | ..... | F02B 47/00 123/1 A |
| 3,961,602 A | 6/1976 | Gerry | | |
| 3,961,609 A | 6/1976 | Gerry | | |
| 4,189,914 A | 2/1980 | Maarek et al. | | |
| 4,244,338 A | 1/1981 | Rassey | | |
| 5,267,535 A | 12/1993 | Luo | | |
| 5,400,746 A | 3/1995 | Susa | | |
| 6,516,787 B1 | 12/2003 | Dutart et al. | | |

(Continued)

FOREIGN PATENT DOCUMENTS

| | | | | |
|---|---|---|---|---|
| GB | 2425808 | | 8/2006 | |
| WO | WO 2010036093 | * | 4/2010 | ..... F02B 47/02 |

OTHER PUBLICATIONS ceramatec.com—"Solid Electrolyte Oxygen Separation"—Jan. 29, 2015 (3 pgs.).

(Continued)

*Primary Examiner* — Hai H Huynh

(57) ABSTRACT

A power system including a variable volume combustion chamber for a two-stroke engine having a controlled exhaust port, a fuel injector to the combustion chamber, an oxygen injector to the combustion chamber and a water injector to the combustion chamber. The fuel, oxygen and water injectors controlled by a CPU provide repeated serial pulses of fuel, oxygen and water to complete a charge. An ignition chamber receives a compressed charge then ignited by a spark plug to pass through a restricted port to the main combustion chamber. A source of pressurized concentrated oxygen to the oxygen injector is in a closed air separator having a ceramic membrane of yttrium stabilized zirconia with a synthesized double perovskite nanofiber catalyst coating.

8 Claims, 4 Drawing Sheets

(56) References Cited

U.S. PATENT DOCUMENTS

| | | | | |
|---|---|---|---|---|
| 7,543,577 | B2 * | 6/2009 | Ha | F02M 25/10 123/585 |
| 7,958,872 | B1 * | 6/2011 | Schechter | F02M 26/35 123/568.11 |
| 8,479,690 | B2 | 7/2013 | Maro et al. | |
| 8,511,287 | B2 | 8/2013 | Hofbauer et al. | |
| 8,776,761 | B2 | 7/2014 | Aledavood | |
| 8,925,518 | B1 | 1/2015 | Riley | |
| 9,850,856 | B1 | 12/2017 | Turner, Jr. | |
| 10,408,168 | B2 | 9/2019 | Turner, Jr. | |
| 2002/0104518 | A1 | 8/2002 | Keefer | |
| 2007/0245982 | A1 | 10/2007 | Sturman | |
| 2007/0266995 | A1 | 11/2007 | Ha et al. | |
| 2008/0223332 | A1 | 9/2008 | Maro | |
| 2010/0107994 | A1 | 5/2010 | Moriarty | |
| 2013/0037003 | A1 | 2/2013 | Sheerin et al. | |
| 2015/0260131 | A1 | 9/2015 | Riley | |

OTHER PUBLICATIONS airproducts.com News Release "Air Products Breaks Ground on Louisiana ITM Oxygen Production Test Facility", Sep. 14, 2011, Lehigh Valley, PA (3 pgs.).
Article, "Japanese Tornadoes", Jan. 9, 2015 (p. 1, ¶ 2).
Picture, Maserati MC20 engine with "passive pre-chamber" prior art.

* cited by examiner

POWER SYSTEM WITH INTERNAL COMBUSTION ENGINE

BACKGROUND OF THE INVENTION

The field of the present invention is power systems employing alternatively aspirated internal combustion engines.

Power systems using internal combustion engines, particularly for powering vehicles and craft have mixed fuel with air containing oxygen drawn into variable volume cylinders for combustion. Such systems advantageously do not require the fuel oxidizer to be carried around with the system. However, the use of air dilutes the oxidizer-fuel charge and entrains nitrogen into the combustion process resulting in unwanted oxides of nitrogen. Because the oxidizer is diluted, such engines also must deal with large volumetric flow through the engine including the substantial nonproductive air components, impacting design and operation.

Concentrated oxygen has been contemplated for use in engines. Reference is made to U.S. Pat. No. 3,961,609 to Gerry and U.S. Pat. No. 8,479,690 to Maro et al. A power system employing an internal combustion engine, a source of fuel and a source of concentrated oxygen using multiple injections of both the fuel and the oxygen is disclosed in U.S. Pat. Nos. 9,850,856 and 10,408,168 to Turner et. al., the disclosures of which are incorporated herein by reference.

SUMMARY OF THE INVENTION

The present invention is directed to a power system employing an internal combustion engine receiving a charge of fuel, concentrated oxygen and water. By using concentrated oxygen under pressure, all three components can be injected using multiple pulses for the combustion chamber charge. Such operation allows for greater control of oxygen-fuel ratios, ignition, burn rate, temperature and expansion of the charge. Complications resulting from constituents of air inducing air pollution can be diminished or avoided; and overall engine and vehicle efficiency can provide a substantial increase in fuel economy. Water provides increased volumetric expansion and can retard burn rate and temperature spikes. Enhanced mixing and variation in oxygen/fuel ratios per stroke are also possible. An ignition chamber receiving an oxygen-fuel mixture from the first pulse to the cylinder can generate an ignition jet to the combustion chamber when ignited by a spark to insure more complete combustion of subsequent, leaner charges. The source of oxygen may separate oxygen from nitrogen in an air separator enhanced by combustion heat using a membrane having a synthesized double perovskite nanofiber coating.

In a preferred embodiment, fuel, oxygen and water are serially injected repeatedly during the power stroke of the piston, in the absence of air. The fuel, oxygen and water injectors can be controlled by a CPU to provide combustion commensurate with the demand as needed through the power stroke, and to maintain an appropriate oxygen-fuel ratio of the accumulated final charge. One or more injectors may be angled away from the centerline of the cylinder, along with compatible shape of the combustion chamber 15, to promote greater mixing such as by swirl and/or tumbling.

The source of concentrated oxygen includes an oxygen separator. The separator separates oxygen from other constituents of air. Ionic transport membranes form one category of such devices which are applicable for mobile and stationary use with an engine. The preferred embodiment employs a yttrium stabilized zirconia membrane coated with a synthesized double perovskite nanofiber catalyst. Such devices have the capability of producing oxygen with a purity of at least 99.94%. Ionic transport membrane devices are typically advantaged for efficient operation by elevated temperatures and pressures. The case enclosing such a membrane is arranged in a heat transfer relationship with the engine exhaust and receives compressed air feed to maintain an appropriate environment for operation of the membrane. Other devices may be used that are less capable of such purity but adequately concentrate oxygen to attain sufficient volumetric efficiency to make oxygen injection practical and advantageous and to significantly avoid exhaust pollutants.

Also, in a preferred embodiment, the source of concentrated oxygen includes an oxygen reservoir to receive the oxygen output from the membrane before it is passed to the oxygen injector. The reservoir is a tank of sufficient size to accommodate fluctuations in both production to and usage from the reservoir. Further, oxygen may be accumulated in the tank during operation of the system to be used for purposes of restart when the conditions in the membrane do not admit of efficient concentrated oxygen production.

The density of the concentrated oxygen from the source can be increased beyond that which can be supplied by efficient operation of the membrane generator. Further pump compression after the oxygen separator as well as intercooling can increase the quantity of concentrated oxygen per unit volume to the engine. Refrigeration of the oxygen reservoir can also be used to the same end.

The reduced volumetric flow through the engine and employment of an oxygen injector provide the advantageous employment of an internal combustion engine having a cycle completed in two strokes of the piston. The engine is able to complete fuel, oxygen and water introduction and combustion continuing during the down stroke and substantially complete scavenging of the combusted mixture with the subsequent upstroke in the two-stroke cycle. The introduction of the components of combustion is accomplished with the injectors. The exhausting of the combusted components is accomplished with a controlled exhaust port which can be fully closed during the power stroke.

Accordingly, it is a principal object of the present invention to provide an improved power system using an internal combustion engine. Other and further objects and advantages will appear hereinafter.

DETAILED DESCRIPTION OF THE PREFERRED EMBODIMENTS

Turning in detail to the system illustrations, a power system is illustrated with power provided by an internal combustion engine 10 employing a cycle completed in two strokes. The engine 10 is illustrated to be a 90° V4 with a conventional cylinder block, crankshaft, pistons, connecting rods and rotary power output equipment. This is one example of use and configuration. Stationary and vehicular engines as well as single cylinder and other multi-cylinder engines are contemplated. In the illustrated example, a conventional belt-drive off the crankshaft is arranged to drive a cooling water pump, an alternator and an air compressor. A conventional timing belt drives an exhaust port cam and a water pump. Exhaust manifolds 12 extend directly out of heads 14 to accumulate exhaust in a collector 16 defining a single exhaust outlet.

Figure 1:
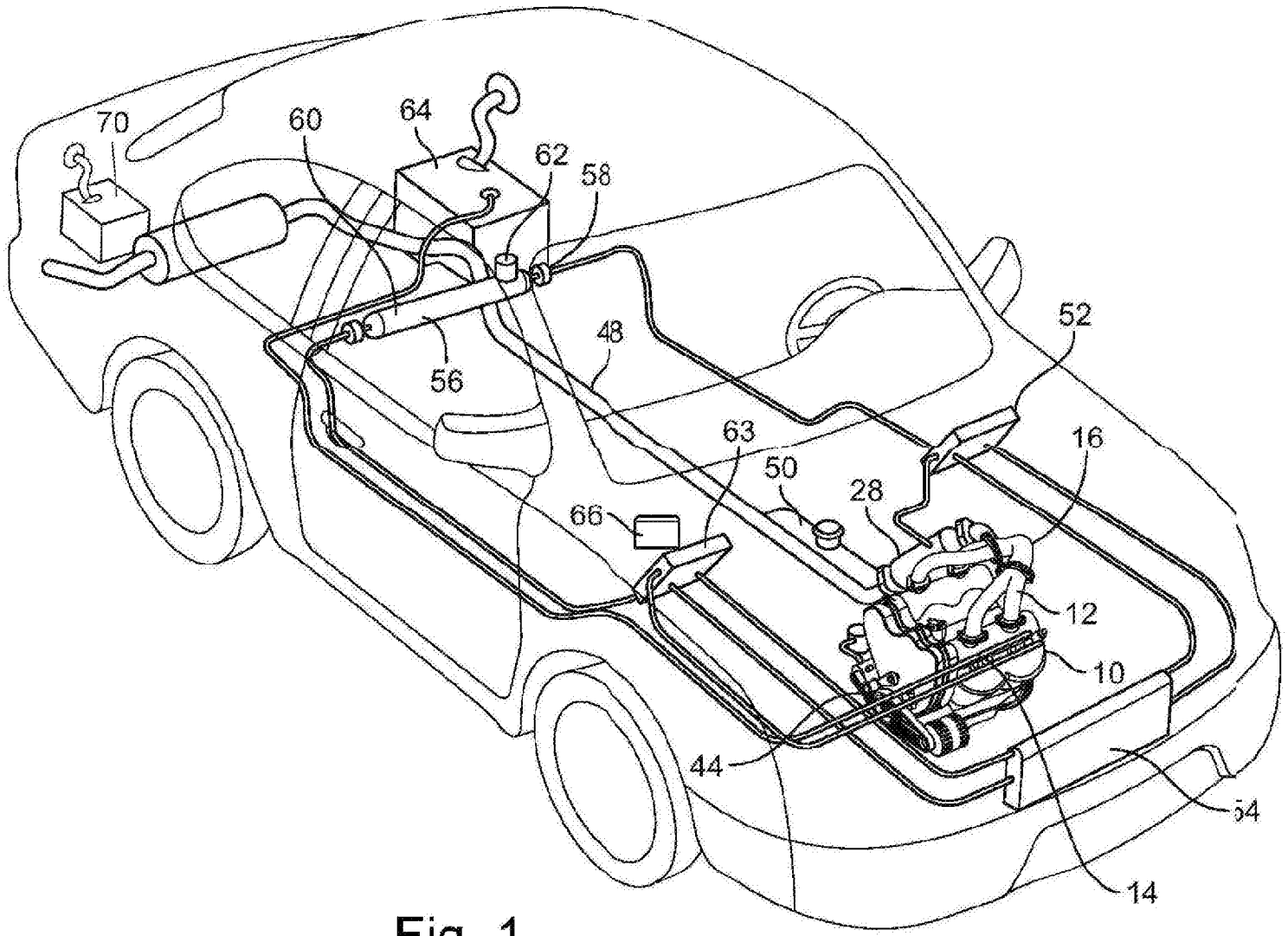
FIG. 1 is an illustrative system view of a power system as may be employed in a vehicle.
Figure 2:
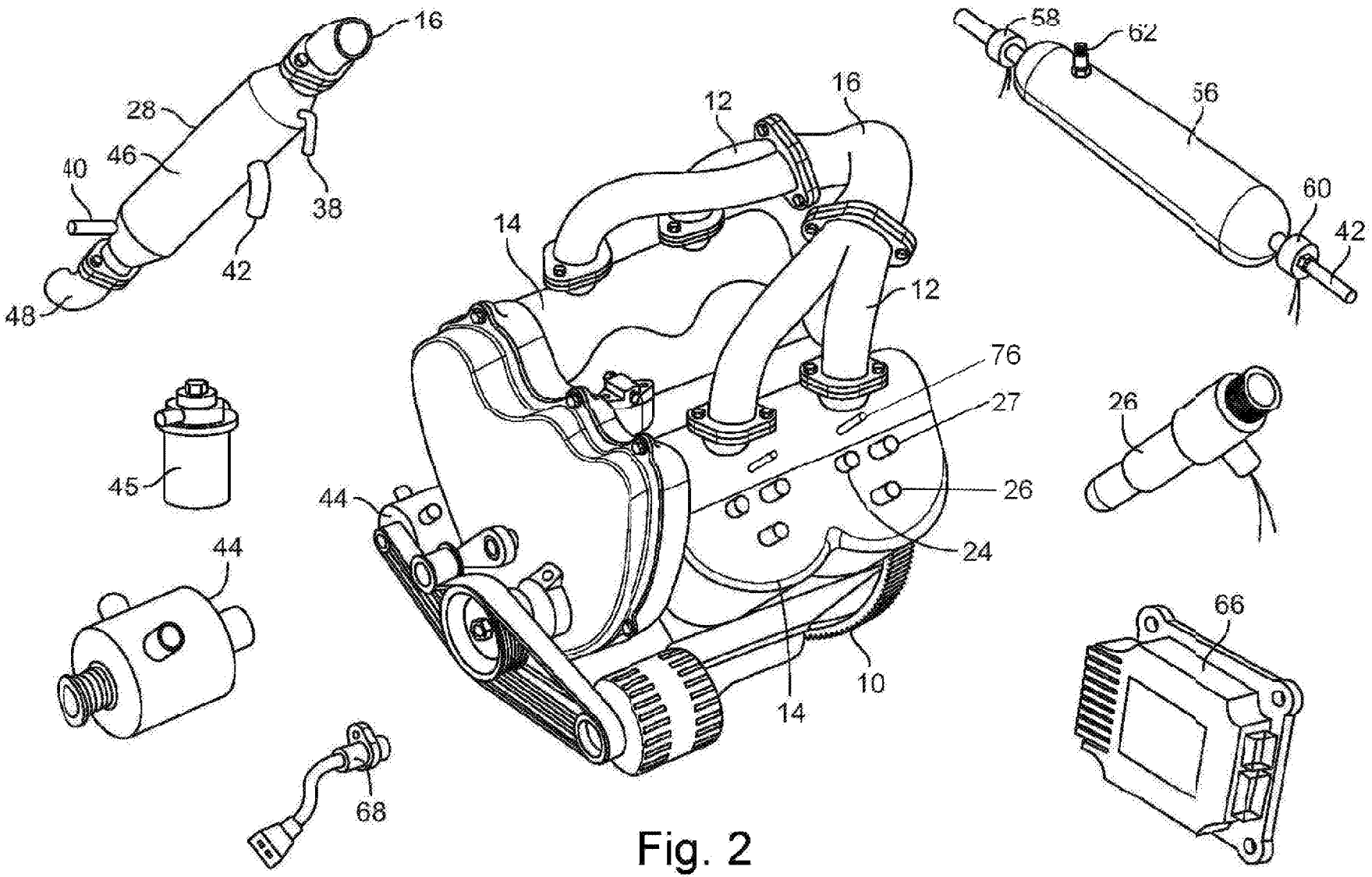
FIG. 2 is an illustrative system view of system components of the source of pressurized concentrated oxygen associated with an internal combustion engine.
Figure 4:
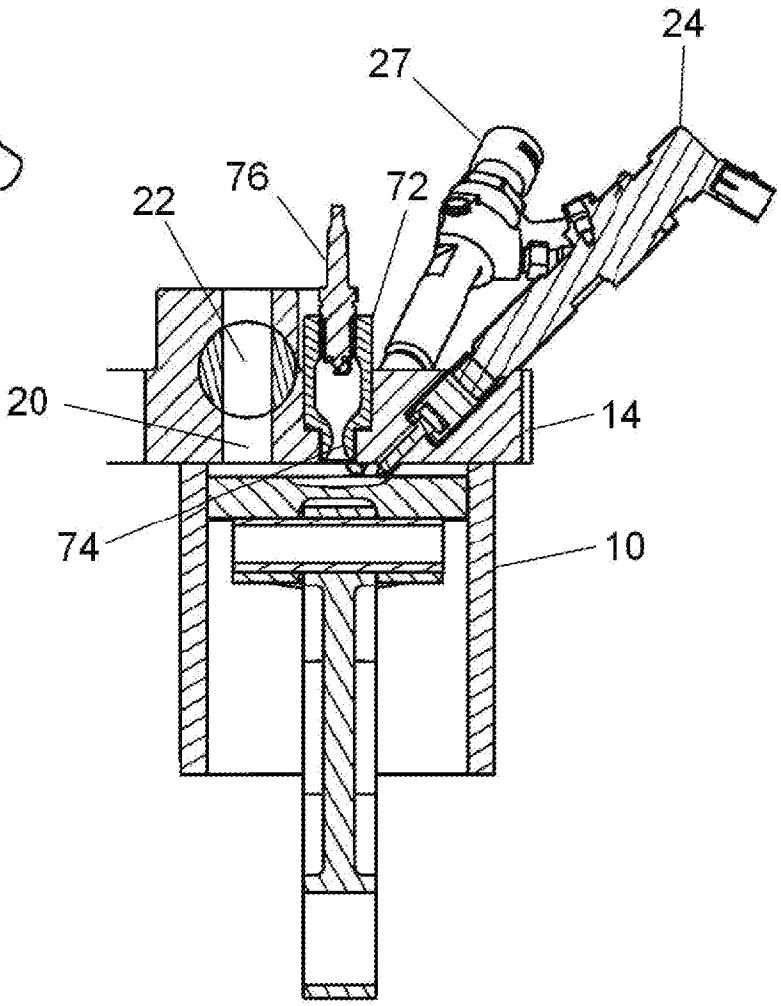
FIG. 4 is a cross-sectional view taken along line 4-4 of the engine cylinder of FIG. 3.
Figure 3:
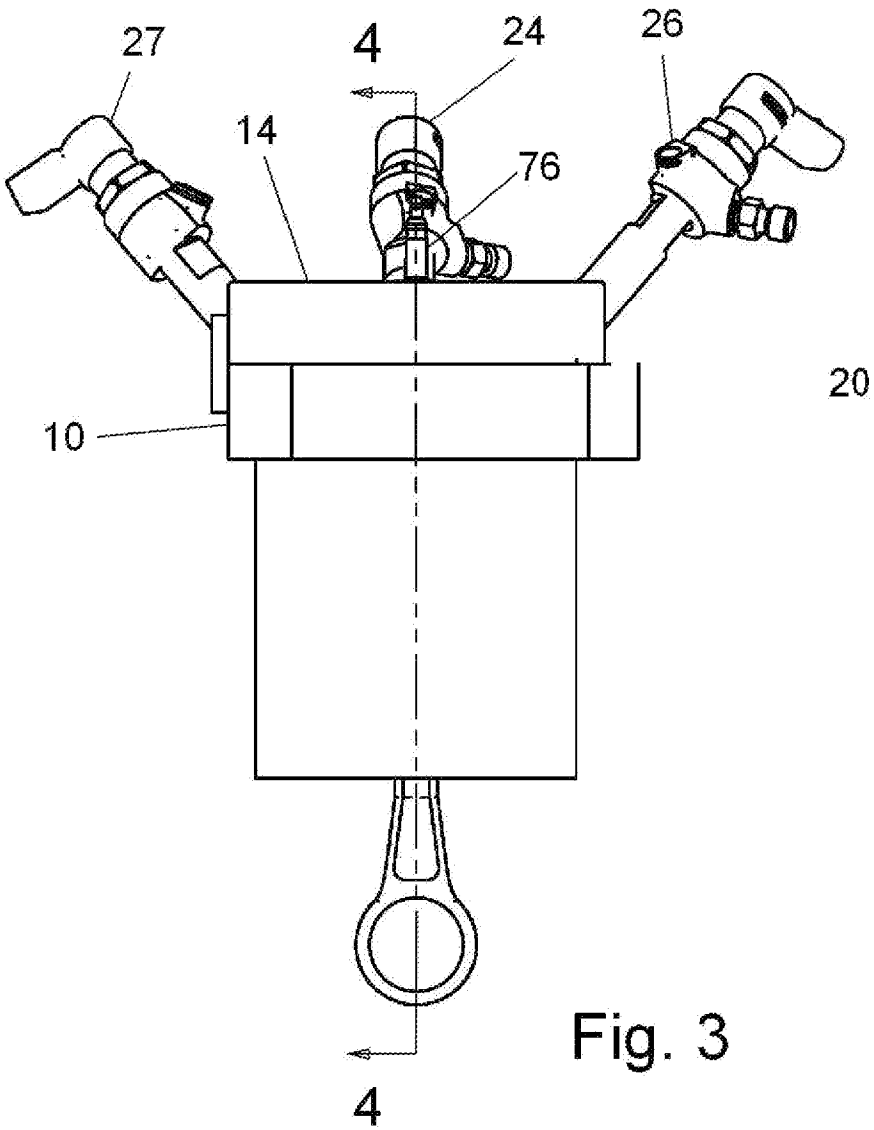
FIG. 3 is a side view of an engine cylinder.

The arrangement of the heads 14 associated with the combustion chambers 18 is illustrated in FIGS. 3 and 4. Each variable volume combustion chamber 18 includes a portion of the head 14 having a controlled exhaust port 20 with a rotary valve 22 controlling the port. As the valve can allow flow in each direction, it may be rotated at half speed, with one rotation during two exhaust strokes. FIG. 4 illustrates a cross section through the port 20. A fuel injection system 24, an oxygen injection system 26 and a water injection system 27 extend to the combustion chamber 18 conveniently angularly displaced from one another about the head 14 of the chamber 18. The exact arrangement and orientation of the injectors of the injection systems 24, 26, 27 are to be empirically determined for each combustion chamber configuration.

The fuel injection system 24, whether injecting liquid or gaseous fuel, and oxygen injection system 26 are conventional products readily acquired, each most typically including a common rail distribution system with a solenoid injector 24, 26 at each combustion chamber electronically controlled by a CPU 66 that is timed by a crankshaft position sensor, a direct injection pump cam sensor and an exhaust valve cam shaft sensor. The water injection system 27 is similarly arranged and controlled. One or more of the injectors of the injection systems may be angled away from the centerline of the cylinder to generate mixing such as swirl and tumbling.

Figure 5:
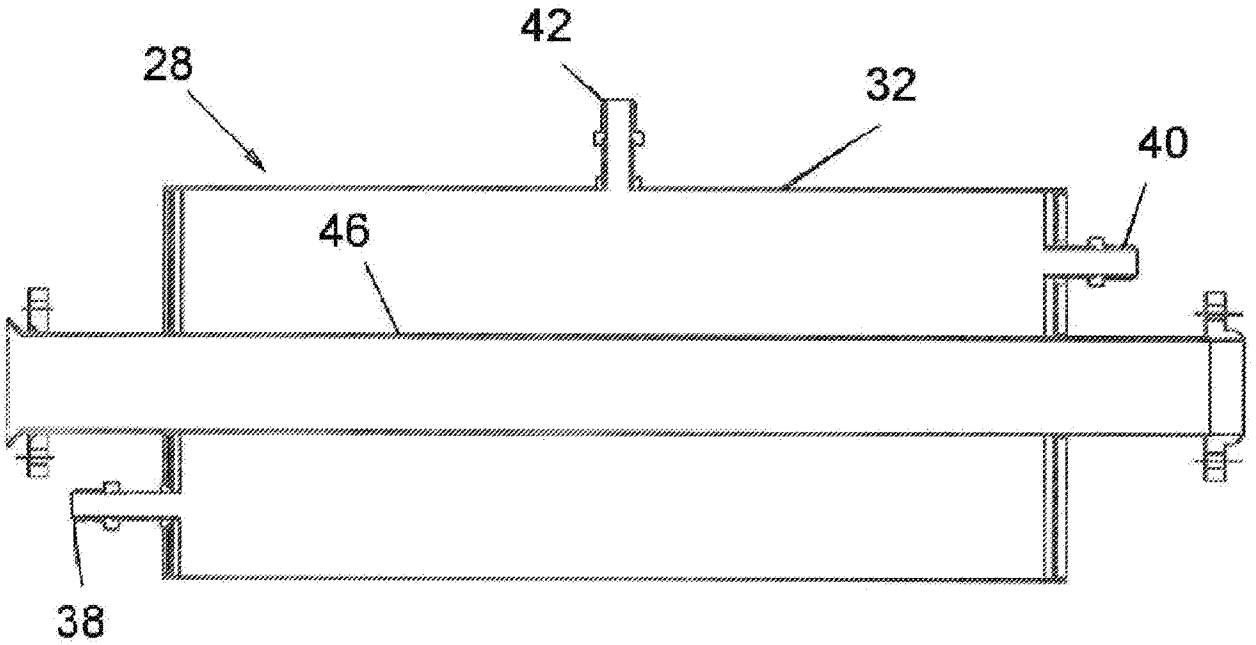
FIG. 5 is a plan view illustration of an oxygen separator.
Figure 6:
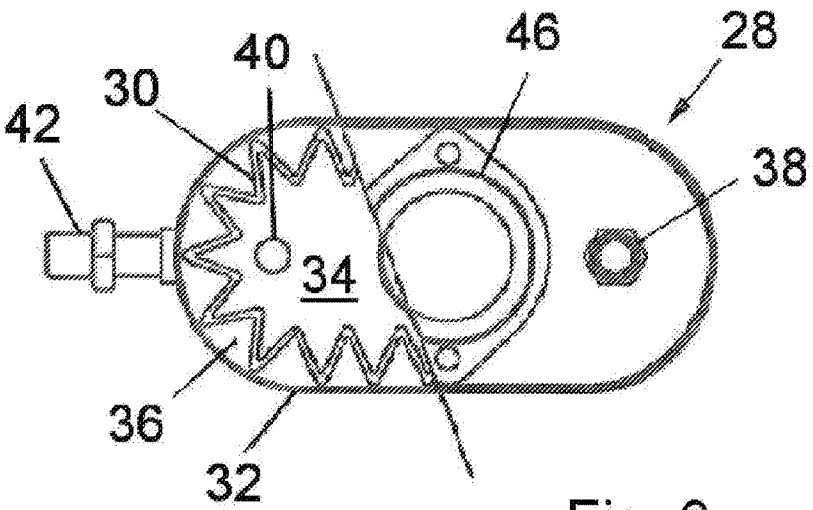
FIG. 6 is a schematic partially sectioned end view illustration of the oxygen separator of FIG. 5.

A source of concentrated oxygen includes an oxygen separator 28 illustrated in FIGS. 5 and 6. The oxygen separator 28 in the preferred embodiment is of a type including a pleated membrane 30 doped with perovskite or fluorites in a closed case 34. The closed case 34 has the membrane 30 located within the interior of the case defining a central air cavity 32 and an oxygen cavity 36 about the periphery. The membrane is a ceramic membrane of yttrium stabilized zirconia with a synthesized double perovskite nanofiber catalyst coating that extends the length between cavities allowing restricted flow therethrough. The case 32 also includes a waste outlet 40 also in communication with the first side of the membrane 30. Finally, the case 32 includes an oxygen outlet 42 which is in communication with the cavity 36 outwardly of the membrane 30.

The operating conditions of such oxygen separators typically include a differential pressure across a membrane of 10 to 90 bar and temperatures ranging from 500 to 700° C. To achieve such pressure differentials, the air inlet 38 is in communication with an air compressor 44. Such an air compressor 44 is shown to be belt-driven by the engine 10 to achieve operating pressures for the oxygen separator 28. A conventional water, oil and particle separator(s) 45 after the air compressor 44 protects the membrane 30. An additional pump after the oxygen outlet 42 may further increase the pressure drop across the membrane 30 and also act to boost pressure to the downstream components further discussed to provided pressurized oxygen to the engine injection system.

To achieve appropriate temperatures in the oxygen separator 28, a heat transfer association between the case 32 and the exhaust is used in addition to compressional heating by the air compressor 44 to provide a source of heat energy from the engine. In the preferred embodiment, a conduit 46 is arranged through the middle of the closed case 32. The conduit 46 is directly coupled with the exhaust collector 16 such that exhaust will flow through the closed case for heat transfer from the exhaust to the air flow into and through the ceramic membrane. The conduit 46 is also in communication with an exhaust pipe 48 to direct minimally restricted exhaust away from the equipment. The conduit 46 is preferably of thermally highly conductive material such as metal and may contain heat transfer enhancements such as fins or the like. More elaborate heat transfer devices may be used to increase heat transfer between the exhaust and the compressed air. Other heating sources may be used to accelerate and/or augment heating of the oxygen separator 28 or the incoming compressed air.

In considering various devices available in the art to be included here in the use of the phrase "oxygen separator", air is considered to be principally made up of molecules of nitrogen and oxygen, accounting for approximately 99 mole percent, in a ratio of 78 N2 to 21 O2. The task may thus be considered one of separating oxygen and nitrogen to achieve a sufficient concentration of oxygen for volumetrically efficient engine operation. A useful concentration of oxygen may be obtained by a significant removal of nitrogen alone from air, whether the technology is principally considered to be separating oxygen from air or nitrogen from air. Thus, oxygen separators in addition to the oxygen separator 28 of the preferred embodiment are included here, devices which concentrate oxygen to attain sufficient volumetric efficiency to make oxygen injection practical and advantageous and to meet clean air standards without requiring exhaust catalytic conversion of oxides of nitrogen. The more limiting is the avoidance of oxides of nitrogen. An oxygen separator system which removes nitrogen from air to generate a gas stream therefrom that is at least 98 mole percent oxygen is sufficient to achieve these benefits.

Each of known membrane technologies, which include fiber membranes, hollow fiber membranes and solid electrolyte oxygen separation, and known pressure and vacuum swing technologies may be appropriated for oxygen separation in the source of concentrated oxygen to the engine. Such oxygen separators are preferably operated where most efficient, whether at high pressure and temperature or low. Generally, an air compressor 44 is to be used to properly charge the oxygen separator. Further boost to injection pressure may be accomplished with a gas compressor associated with the injector system. The choice of such known technologies and devices may depend on the type of vehicle or craft or stationary power source contemplated.

Returning to the preferred embodiment, to ensure that the appropriate working pressure in the case 32 is not exceeded, the waste outlet 40 is restricted by a conventional waste gate 50. The waste gate 50 is set at a predetermined pressure to maintain the closed case 32 in an efficient pressure range. Relief above a predetermined pressure through the waste gate 50 is permitted to flow to the exhaust pipe 48.

The source of pressurized concentrated oxygen from air provides a stream from the ceramic fiber membrane 30 through the oxygen outlet 42 which is at least 98 mole percent oxygen. The pressurized concentrated oxygen is shown in the preferred embodiment to first be directed to an intercooler 52 to cool the oxygen, increasing oxygen density. The intercooler 52 may be conveniently water cooled by a radiator 54 as may be available when the power system is used on a vehicle. Further gas pressure can also be obtained after the oxygen outlet 42 by a gas compressor which may be independent or a separate compressor component stage in the air compressor 44 (communication lines not shown) driven in either case directly or indirectly by the engine 10. For better efficiency, gas compression would appropriately be followed by gas cooling. The concentrated oxygen at a preferred pressure is then directed to an oxygen tank 56.

The oxygen tank 56 preferably has the capacity to maintain a sufficient volume of concentrated and pressurized oxygen to provide starting and warmup for the engine and ceramic fiber membrane 30 from a cold start. Additionally, the capacity of the oxygen tank 56 accommodates fluctuations in increased engine demand and variations in the output of the oxygen separator 28.

An inlet regulator 58 and an outlet regulator 60 are arranged at the inlet and outlet of the oxygen tank 56, respectively. The outlet regulator 60 maintains a constant pressure for discharging concentrated and pressurized oxygen to the oxygen injectors 26. The inlet regulator 58 prevents backflow toward the ceramic fiber membrane 30 and provides a maximum pressure signal if the oxygen tank becomes over pressurized. A primer valve 62 provides access to the oxygen tank 56 for additional charging. A further increase in density of the concentrated oxygen for volumetric efficiency may be additionally or alternatively provided by an intercooler 63 between the oxygen tank 56 and the engine 10. Such an intercooler 63 may be thermally coupled with the radiator 54 or otherwise cooled. The intercooler 63 may be paired with a compressor, again, independent or a separate compressor component stage in the air compressor 44 (communication lines not shown) driven in either case by the engine 10. Alternatively or additionally, refrigeration of the oxygen tank 56 may be employed toward the same end.

Fuel to be delivered to the fuel injectors 24 is maintained in an appropriate fuel tank 64. A low-pressure pump having conventional 50 to 60 psi capacity (not shown) is associated with the fuel tank 64. A higher-pressure tank and pump would be used for gaseous fuel. The fuel injection system is also conventional, most typically a common rail distribution system including a high-pressure direct injection fuel pump boost to 2900 psi. Conventional solinoid injectors 24 at each combustion chamber are fed by the distribution system and electronically controlled by the CPU 66 timed by a crankshaft position sensor 68, a direct injection pump cam sensor and an exhaust valve cam shaft sensor.

Water employs hardware, similar to that of liquid fuel, associated with a water tank 70 feeding the water injectors 27 controlled by the CPU 66. The water tank 70 may be charged like the fuel tank 64; or the water may be recovered from the products of combustion and charged water to the cylinders.

The exhaust valves 22 in the exhaust ports 20 are rotary valves controlled by a conventional valve train driven by a crankshaft. No intake valve is needed as no air is involve in the cylinder charge.

The cylinder head 14 further includes an ignition chamber 72 having a restricted port 74 between the ignition chamber 72 and the cylinder. The restriction is shown to be a venturi, causing increased mixing as oxygen and fuel are charged to the chamber and a dispersive effect on combusting gasses accelerated through the restriction with the venturi 74 at the outlet. A spark plug 76 extends into the chamber for ignition. A further spark plug (not shown) may also be mounted in the engine head 14 and extend directly into the combustion chamber 18 to augment ignition.

The operation of the power system is preferably controlled by the electronic control unit 66. Such units, commonly referred to as engine control modules, are commonly employed to regulate various vehicle engine operations. The CPU 66 can monitor pressures and temperatures throughout the system and may receive the overpressure signal from the inlet regulator 58 on the oxygen tank 56. Further, the CPU 66 may appropriately engage or disengage an electric clutch drive or drives on the air compressor 44 to maintain pressure in the oxygen tank 56 and elsewhere within appropriate boundaries. The CPU 66 further can monitor throttle input from a vehicle and modulate fuel, oxygen and water to the combustion chambers through conventional control of the injectors 24, 26, 27. This modulation, typically based on mapped fuel curves, provides control of engine power and at the same time achieve a final charge from the accumulated pulses maintaining an appropriate oxygen-fuel ratio charge through the power stroke. The CPU 66 can typically measure optimized performance of the engine and any associated vehicle. The crankshaft position sensor 68 is one such device providing input to the CPU 66 for engine control along with a direct injection pump cam sensor and an exhaust valve cam shaft sensor, determining injector timing and control.

Turning to operation of the two-stroke cycle, the fuel, oxygen and water injectors act serially in repeated pulses to charge the combustion chamber as controlled by the CPU 66 for timing and quantity. With regard to the combustion components, the CPU 66 controls the injectors to initiate a first serial injection pulse before top dead center. The intention is to achieve an acceptable total oxygen-fuel charge to the cylinder with each combustion stroke. The fuel and oxygen injectors operate through a series of pulses which provide controlled oxidation of the fuel over a period of time with both oxygen and fuel pulses terminating no earlier than the point of maximum crank leverage. In the current preferred embodiment, the point of maximum crank leverage is at 77° after TDC. Conditions of the burn suggest further advantage to extend charging beyond the maximum crank leverage to as late as 90° after TDC. The timing of and oxygen-fuel ratio between injections can be varied depending on the performance desired. Injection for a cooler and cleaner burn may require different timing and oxygen-fuel ratio than injection for maximum power. With completion of the fuel and oxygen injection in a given stroke, the accumulated ratio of oxygen-fuel injected should be at a stoichiometric or leaner oxygen-fuel ratio.

With a sufficiently lean ratio, the exhaust should only contain carbon dioxide, water, and potentially some remaining oxygen. If the concentrated oxygen is less than pure, unreactive components will also be present. The oxygen purity as to residual nitrogen is to be sufficient to not require catalytic removal of oxides of nitrogen to meet federal vehicle standards; and "concentrated oxygen" is defined for purposes here to mean that which will meet this requirement. A concentration of 98 mole percent oxygen in the stream to the injectors extracted from the air processed through the oxygen separator 28 is understood to meet this requirement.

Ignition is initiated using the ignition chamber 72 in the cylinder head. The initial pulse or pulses of the serial injections are injected before TDC in order to drive charge into the ignition chamber 72 as the piston moves toward the head. Full closure of the exhaust port 20 is tuned to occur soon enough that a first pulse of the serial injection will be forced under pressure into the ignition chamber 72. This initial charge may be comparatively rich. Once accomplished, the spark plug is timed to fire, discharging combusting gasses into the main combustion chamber, which may then be receiving subsequent leaner oxygen-fuel ratio pulses.

If liquid hydrocarbons are the fuel, they may be introduced under a conventional 2900 psi pressure. Fuel may be preconditioned through heating. Reference is made to U.S. Pat. No. 8,511,287 to Hofbauer et al., the disclosure of which is incorporated herein by reference. Ambient oxygen temperature prior to injection is most convenient. Refrigeration may also be employed to increase total efficiency. The oxygen injection is with the concentrated oxygen at 90 bar and at a temperature lowered from that generated by the prior compression.

Additionally, water is injected with the fuel and oxygen and this serial injecting of fuel, oxygen and water is done so repeatedly during the power stroke under the control of the CPU 66. Each engine design is unique and the conditions change as the engine warms, as engine speeds change and as power is demanded. All must be empirically tuned. Under some conditions, the initial serial injection may be fuel rich and water lean to initiate combustion while a later serial injection may be a leaner oxygen-fuel mix with more water to provide greater expansion and thermal control. An even later serial injection may increase oxygen with less water to complete combustion, for example. The amount of water is to be less than will quench or significantly retard the burn, otherwise resulting in unburned fuel in the exhaust. The appropriate amount of water may also vary with the temperature of the engine.

The exhaust valve 22 is mechanically coupled with the crankshaft of the engine. Spontaneous or induced ignition may impact injection and exhaust port timing. Adequate scavenging of exhaust is not understood to be an issue. In the preferred embodiment, the exhaust port 20 begins to open at 172° after TDC, is fully open at 199° after TDC. Opening of the exhaust port 20 may also begin when most advantageous to maximize scavenging with minimal impact to the power stroke. Full closure of the exhaust port 20 may occur somewhere within the range of 45° and 25° before TDC. Un-scavenged combusted gases can provide extra heat to assist ignition.

Thus, an improved, efficient and clean burning power system has been disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A power system comprising a variable volume combustion chamber including a two-stroke cycle;

a controlled exhaust port from the combustion chamber;

a fuel injector system including at least one fuel injector directed to the combustion chamber;

a source of fuel constructed and arranged to charge the fuel injector system with fuel;

an oxygen injector system including at least one oxygen injector directed to the combustion chamber;

a source of pressurized oxygen constructed and arranged to charge the oxygen injector system with oxygen, the source of pressurized oxygen including an oxygen separator constructed and arranged to separate oxygen from air and an air intake to the oxygen separator, the at least one fuel injector and the at least one oxygen injector being the sources of a cumulative stoichiometric or leaner combustible charge to the variable volume combustion chamber;

a water injector system including at least one water injector directed to the combustion chamber;

a source of water constructed and arranged to charge the water injector system with water, the fuel injector system, the oxygen injector system and the water injector system constructed and arranged to serially inject fuel, oxygen and water repeatedly into the combustion chamber.

2. The power system of claim 1, each fuel, oxygen and water injector being a variable volume injector, the volumes of each injection being controlled by a CPU.

3. The power system of claim 1, the at least one fuel injector and the at least one oxygen injector being the exclusive sources of a cumulative stoichiometric or leaner combustible charge to the variable volume combustion chamber.

4. The power system of claim 1, the pressurized oxygen provided by the source of pressurized oxygen being at or greater than 98 mole percent.

5. The power system of claim 1, the combustion chamber being defined by a cylinder, piston and engine head, one or more of the fuel, oxygen and water injectors being angled away from the centerline of the cylinder to promote mixing within the chamber.

6. The power system of claim 1, the oxygen separator having a membrane with a synthesized double perovskite or fluorites nanofiber catalyst coating.

7. The power system of claim 6, the membrane being yttrium stabilized zirconia.

8. The power system of claim 1 further comprising an ignition chamber including a spark plug and a restricted port to the variable volume combustion chamber.

* * * * *